US006332503B1

(12) United States Patent
Pessier et al.

(10) Patent No.: US 6,332,503 B1
(45) Date of Patent: Dec. 25, 2001

(54) FIXED CUTTER BIT WITH CHISEL OR VERTICAL CUTTING ELEMENTS

(75) Inventors: Rudolf C. O. Pessier, Houston; Danny E. Scott, Montgomery, both of TX (US); Matthias Meister, Celle (DE); Ronny D. McCormick, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/212,057

(22) Filed: Dec. 15, 1998

Related U.S. Application Data

(63) Continuation-in-part of application No. 08/909,974, filed on Aug. 12, 1997, now Pat. No. 6,050,354, which is a continuation-in-part of application No. 08/468,215, filed on Jun. 6, 1995, now Pat. No. 5,655,612, which is a continuation-in-part of application No. 08/300,502, filed on Sep. 2, 1994, now Pat. No. 5,467,836, which is a continuation-in-part of application No. 08/169,880, filed on Dec. 17, 1993, now Pat. No. 5,346,026, which is a continuation-in-part of application No. 07/830,130, filed on Jan. 31, 1992, now Pat. No. 5,287,936.

(51) Int. Cl.[7] ..... E21B 10/12
(52) U.S. Cl. ..... 175/336; 175/430; 175/431
(58) Field of Search ..... 175/336, 430, 175/420.1, 426, 431, 428

(56) References Cited

U.S. PATENT DOCUMENTS

| | | | | |
|---|---|---|---|---|
| Re. 33,757 | | 12/1991 | Weaver . | |
| 4,333,540 | | 6/1982 | Daniels et al. . | |
| 4,529,047 | * | 7/1985 | Meskin et al. | 175/329 |
| 4,558,753 | * | 12/1985 | Barr | 175/329 |
| 4,570,726 | * | 2/1986 | Hall | 175/410 |
| 4,673,044 | * | 6/1987 | Bigelow et al. | 175/329 |
| 4,872,520 | * | 10/1989 | Nelson | 175/329 |
| 5,282,513 | | 2/1994 | Jones . | |
| 5,287,936 | | 2/1994 | Grimes et al. . | |
| 5,346,026 | | 9/1994 | Pessier et al. . | |
| 5,467,836 | | 11/1995 | Grimes et al. . | |
| 5,499,688 | | 3/1996 | Dennis . | |
| 5,566,779 | | 10/1996 | Dennis . | |
| 5,655,612 | | 8/1997 | Grimes et al. . | |
| 5,823,277 | * | 10/1998 | Delwiche et al. | 175/428 |
| 6,003,623 | * | 12/1999 | Miess | 175/430 |

* cited by examiner

*Primary Examiner*—David Bagnell
*Assistant Examiner*—Zakiya Walker
(74) *Attorney, Agent, or Firm*—Bracewell & Patterson, L.L.P.

(57) ABSTRACT

An array of chisel-shaped cutting elements are mounted to the face of a fixed cutter bit. Each cutting element has a crest and an axis which is inclined relative to the borehole bottom. The cutting elements have a hardened diamond exterior on all surfaces in contact with the formation. The chisel-shaped cutting elements may be arranged on a selected portion of the bit, such as the center of the bit, or across the entire cutting surface. In addition, the crest on the cutting elements may be oriented generally parallel or perpendicular to the borehole bottom. The chisel shape and crest orientation increase the initial contact area while reducing aggressiveness. These advantages are achieved without increasing cutter density, reducing back rake, or adding depth of cut limiters. Chisel-shaped cutting elements having crests which are oriented perpendicular to the borehole bottom have the added advantage of displacing the material in a plane that is parallel to the bit face. This reduces the likelihood of harmful bit balling, particularly on heavy set bits with small open face volume.

14 Claims, 6 Drawing Sheets

FIXED CUTTER BIT WITH CHISEL OR VERTICAL CUTTING ELEMENTS

Cross-Reference to Related Application

This application is a continuation-in-part of application Ser. No. 08/909,974 filed on Aug. 12, 1997 now U.S. Pat. No. 6,050,345, which was a continuation-in-part of application Ser. No. 08/468,215 filed on Jun. 6, 1995, now U.S. Pat. No. 5,655,612, which was a continuation-in-part of application Ser. No. 08/300,502 filed on Sep. 2, 1994, now U.S. Pat. No. 5,467,836, which was a continuation-in-part of application Ser. No. 08/169,880 filed on Dec. 17, 1993, now U.S. Pat. No. 5,346,026, which was a continuation-in-part of application Ser. No. 07/830,130 filed on Jan. 3, 1992, now U.S. Pat. No 5,287,936.

TECHNICAL FIELD

This invention relates in general to earth-boring drill bits and in particular to the hard inserts utilized in earth-boring drill bits.

BACKGROUND ART

Earth-boring bits of the rolling cone variety rely on the rolling movement of at least one cutter over the bottom of the bore hole for achieving drilling progress. The earth-disintegrating action of the rolling cone cutter is enhanced by providing the cutter with a plurality of protrusions or teeth. These teeth are generally of two types: milled teeth, formed from the material of the rolling cone; and inserts, formed of a hard material and attached to the rolling cone surface. Earth-boring bits of the fixed cutter variety, commonly referred to as drag bits, have no moving parts and employ an array of hard inserts to scrape and shear formation material as the bit is rotated in the borehole.

Until now, inserts on prior art fixed cutter bits have been aligned such that the inserts will scrape the material of the borehole bottom. For scraping to take place, the longitudinal axis of the insert is typically at a small acute angle, such as zero to 30 degrees relative to the bit face. Such an alignment places the cutting face of a cylindrically shaped insert nearly perpendicular to the borehole bottom. The contact area between the cutting element and the formation starts out to be very small but increases rapidly as penetration or depth of cut becomes deeper.

Cutting elements which have high initial aggressiveness are desirable in applications where weight on bit and torque are limited and a maximum rate of penetration for a given weight on bit is the goal. They can become a liability in applications where the weight on bit cannot be accurately controlled, as in directional drilling which causes harmful torsional oscillations. Commonly used approaches to reduce aggressiveness of directional bits include increased cutting face inclination (back rake), depth of cut limiters and increased cutting element density.

The high initial aggressiveness can also cause problems in hard, abrasive materials where the highly loaded tip of the cutting edge quickly breaks down and a large wear flat develops on the bottom side of the cutting element, bringing the much less wear resistant tungsten carbide backing into contact with the formation. This leads to accelerated wear and/or heat checking with subsequent catastrophic breakdown of the cutting element. Another shortcoming of the conventional cutting element shape and alignment is the flow of the drilled-up material or shavings, which is directed vertically upward into the face of the bit. On heavier set, high cutter density bits with small open face volume, it frequently leads to severe bit balling.

DISCLOSURE OF THE INVENTION

An array of chisel-shaped cutting elements are mounted to the face of a fixed cutter bit. Each cutting element has a crest and an axis which is inclined relative to the borehole bottom. The cutting elements have a hardened diamond exterior on all surfaces in contact with the formation. The chisel-shaped cutting elements may be arranged on a selected portion of the bit, such as the center of the bit, or across the entire cutting surface. In addition, the crest on the cutting elements may be oriented generally parallel or perpendicular to the borehole bottom. The chisel shape and crest orientation increase the initial contact area while reducing aggressiveness. These advantages are achieved without increasing cutter density, reducing back rake, or adding depth of cut limiters. Chisel-shaped cutting elements having crests which are oriented perpendicular to the borehole bottom have the added advantage of displacing the material in a plane that is parallel to the bit face. This reduces the likelihood of harmful bit balling, particularly on heavy set bits with small open face volume.

BEST MODE FOR CARRYING OUT THE INVENTION

Figure 1:
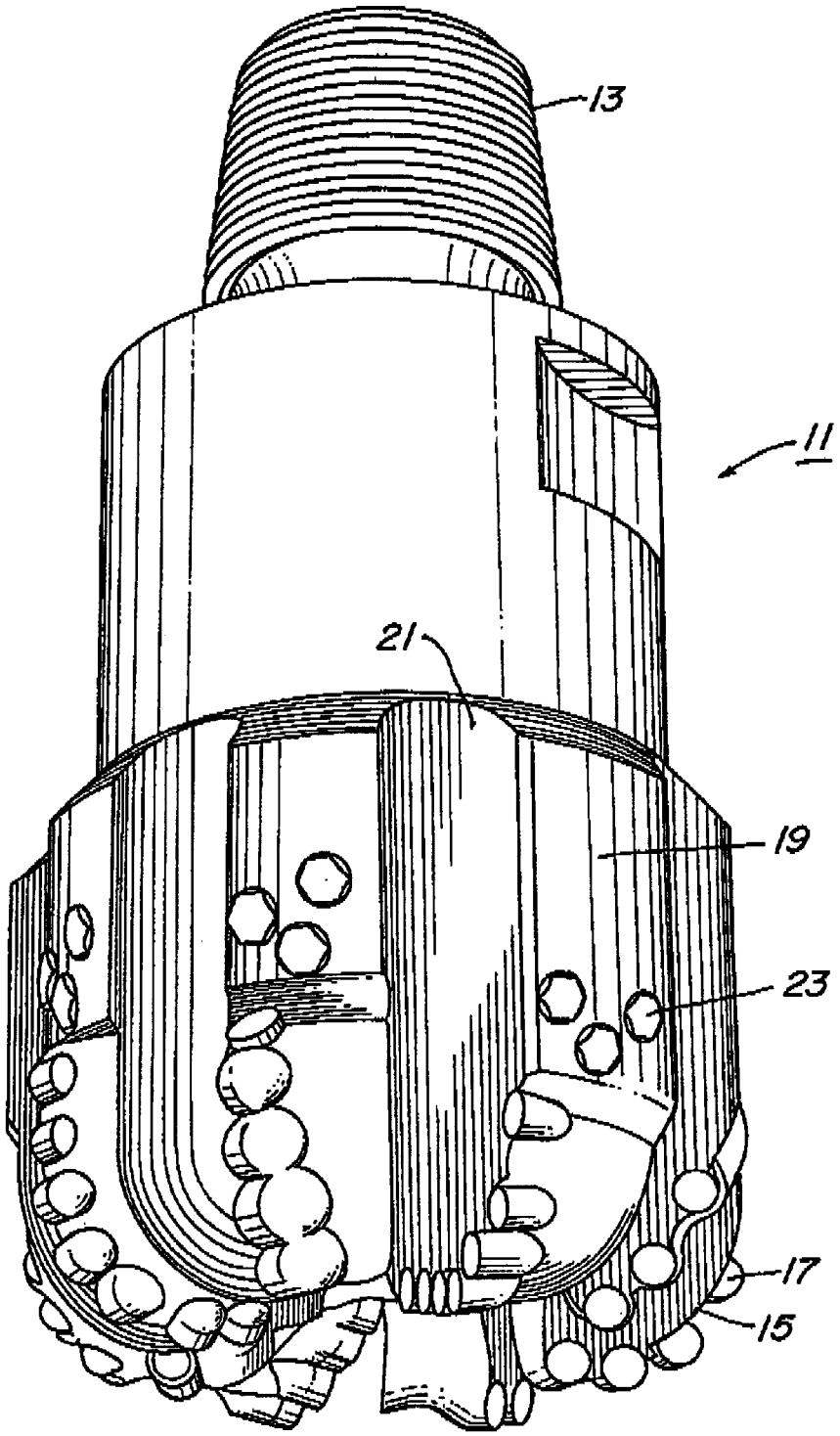
Fig. 1 (PRIOR ART)
FIG. 1 is an isometric view of a prior art earth-boring drill bit of the fixed cutter variety.

Referring to FIG. 1, an earth-boring bit 11 of the fixed cutter variety is shown. Bit 11 has a threaded upper end 13 for connection into a drillstring. A cutting end 15 at a generally opposite end of bit 11 is provided with a plurality of diamond or hard metal cutting elements 17, arranged about cutting end 15 to effect efficient disintegration of formation material as bit 11 is rotated in a borehole. Each cutting element 17 has a cylindrical base which secures in a preformed pocket provided on cutting end 15 and a cutting face which engages the formation material. A gage surface 19 extends upwardly from cutting end 15 and is proximal to and contacts the sidewall of the borehole during drilling operation of bit 11. A plurality of channels or grooves 21 extend from cutting end 15 through gage surface 19 to provide a clearance area for the removal of cuttings and chips formed by cutting elements 17.

A plurality of gage cutting elements or inserts 23 are provided on gage surface 19 of bit 11. Active, shear cutting gage inserts 23 on gage surface 19 provide the ability to actively shear formation material at the sidewall of the borehole to provide dynamic stability and improved gage-holding ability in earth-boring bits of the fixed cutter variety. Bit 11 is illustrated as a polycrystalline diamond cutter (PDC) bit, but cutting elements 23 are equally useful in other fixed cutter or drag bits that include a gage surface for engagement with the sidewall of the borehole. Examples include impregnated and natural diamond bits.

Figure 3:
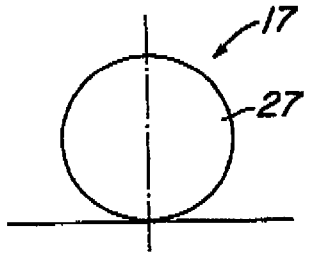
FIG. 3 is a partial plan view of the cutting element of FIG. 2.
Figure 2:
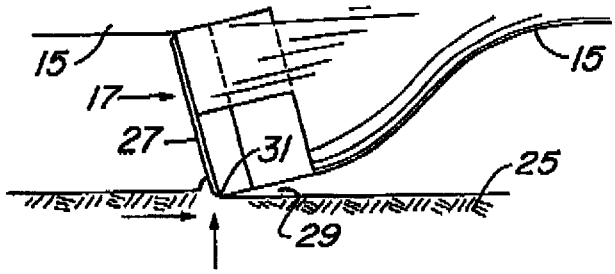
Fig. 2 (PRIOR ART)
FIG. 2 is an enlarged side view of a prior art, horizontally-mounted cutting element.

Referring to FIG. 2, a prior art cutting element 17 for cutting formation 25 is shown. Cutting element 17 is a conventional PDC cutting element and is cylindrical in shape. Cutting element 17 has a diamond table on its rake face 27 and has an essentially circular cross-section (FIG. 3). Cutting element 17 has a clearance angle 29 which makes it quite aggressive since it starts with a point contact 31 and must penetrate formation 25 to half of its diameter before it is cutting over its full width.

Figure 5:
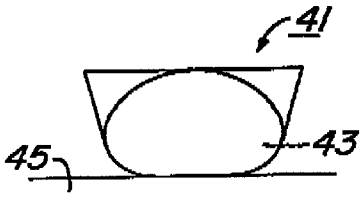
FIG. 5 is a partial plan view of the cutting element of FIG. 4.
Figure 4:
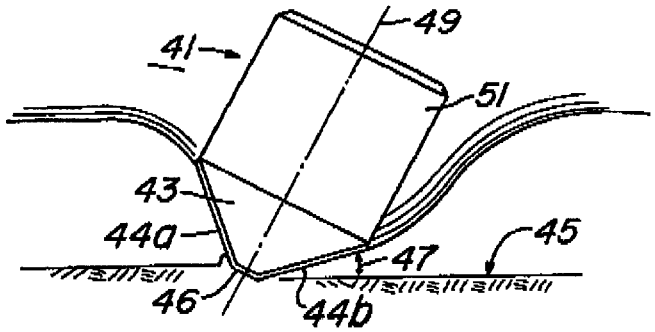
FIG. 4 is an enlarged side view of a chisel-type cutting element of the present invention with the crest that is parallel to the bit face.

Referring now to FIG. 4, a cutting element 41 having chisel-tip 43 with a noncircular rake face performs significantly different than cutting element 17. As shown in FIG. 5, approximately 75% of the width of cutting element 41 starts contacting formation 45 almost immediately. The shape of cutting element 41 distributes contact stresses along a line over a wider area, thus making it relatively less aggressive than cutting element 17 at the lower depths of cut, which are the norm for high speed motor and turbine drilling. The clearance angle 47 of cutting element 41 is defined between a clearance face 44*b* and the borehole bottom 45 and is the same as for the conventional PDC cutting element. The longitudinal axis 49 of cutting element 41 is inclined at an angle of approximately 50 to 85 degrees to borehole bottom 45, or stated another way 50 to 85 degrees relative to a plane perpendicular to the axis of rotation of bit 11.

Figure 8:
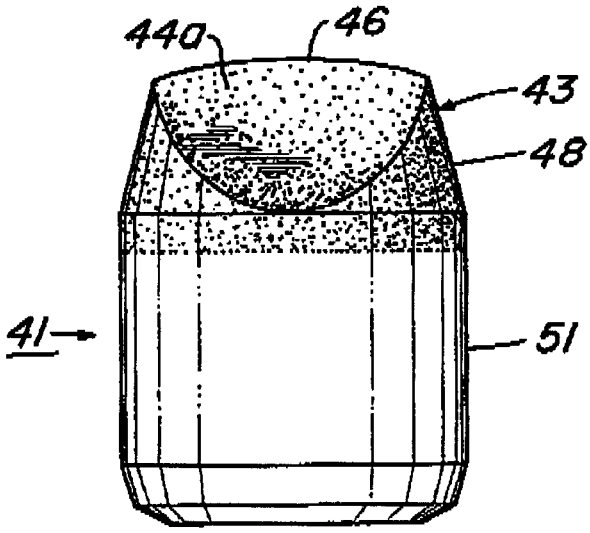
FIG. 8 is a front view of the chisel-type cutting element of FIGS. 4 and 5.
Figure 9:
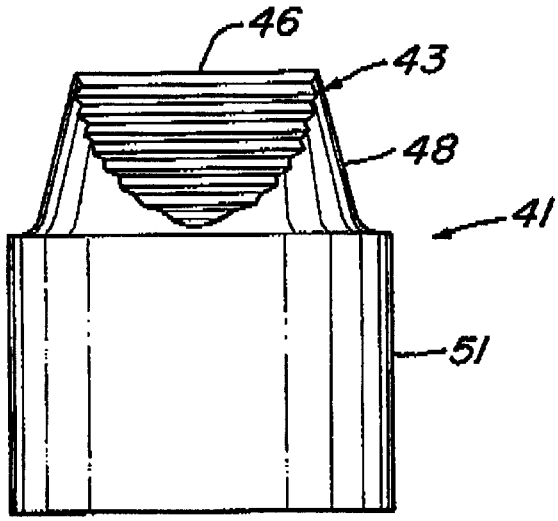
FIG. 9 is a front view of the cutting element of FIG. 8 without the superhard material.

More detailed views of cutting element 41 are shown in FIGS. 8 and 9. As shown in FIG. 8, cutting element 41 comprises a generally cylindrical body 51 formed of hard metal, preferably cemented tungsten carbide. A convex, chisel-shaped or conical cutting end 43 has a pair of symmetrical flanks 44*a*, 44*b* (FIG. 4) converging at about 45 degrees to define a crest 46. A pair of ends 48 connect flanks 44 and crest 46 to body 51. Preferably, cutting end 43 is formed of a layer of super-hard material applied over flanks 44*a*, 44*b*, crest 46, and ends 48 of body 51. Super-hard materials include natural diamond, polycrystalline diamond, cubic boron nitride, and other similar materials approaching diamond in hardness and having hardnesses upward of about 3500 to 5000 on the Knoop hardness scale. Crest 46 is in a plane which extends along axis 49 and is transverse to or facing the direction of rotation.

FIG. 9 shows cutting element 41 prior to the formation of the layer of super-hard material on cutting end 43. For ease of reference, the same numerals are used as are used in FIG. 8, although the super-hard material is not formed on the cutting end 43 of cutting element 41. Flanks 44*a*, 44*b*, crest 46 and ends 48 are of a smaller major diameter than body 51 and define a filleted shoulder to permit application of the layer of super-bard material to result in an element that is continuous and flush in transition from the super-hard material of cutting end 43 to the hard metal of the cylindrical portion of body 51. Flanks 44*a*, 44*b* are provided with substantially linear, parallel lands. The layer of super-hard material engages the lands to provide an interlocking interface on both flanks 44*a*, 44*b* which is resistant to shear and tensile stresses.

The diamond surface on both of the rake and clearance flanks 44*a*, 44*b*, respectively, of cutting element 41 and the lower contact stresses will slow the formation of wear flats and keep the bit sharper for extended periods of operation in hard and abrasive sandstones. Other variations in cutting edge geometry which are feasible include changing the orientation and width of the crest of cutting element 41 and orientation through grinding. The cylindrical body 51 of cutting element 41 is easily installed and secured by interference fit in a matching hole in a steel body bit, making it a good substitute for conventional stud-mounted PDC cutting elements and eliminating the need for the less reliable, more expensive brazing used for conventional pocket mounted cutting elements.

Figure 7:
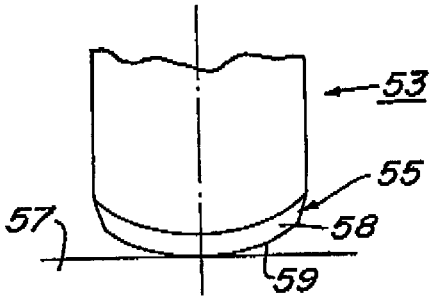
FIG. 7 is a partial plan view of the cutting element of FIG. 6.
Figure 6:
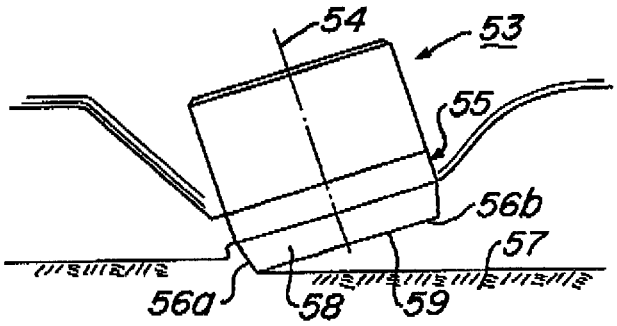
FIG. 6 is an enlarged side view of a vertically-mounted cylindrical cutting element of the present invention.

Referring now to FIGS. 6 and 7, another effectively shaped PDC cutting element is depicted as cutting element 53. Cutting element 53 is an essentially vertically mounted cylinder with a longitudinal axis 54 and an extra thick diamond table 55. Axis 54 is at an angle of 95 to 130 degrees relative to the borehole bottom, or a plane perpendicular to the axis of bit 11. Cutting element 53 is less aggressive than cutting element 17 and has a diamond surface 55 on both its rake and clearance faces 56*a*, 56*b*, respectively. Cutting element 53 has a frustoconical cutting end which forms a bevelled edge 58 and a flat clearance face 59. Cutting element 53 acts more like a plow which directs a higher percentage of the material of formation 57 around itself rather than up the rake face. In an alternate embodiment (not shown), a polygonal perimeter or bevel rather than a circular shape will further enhance the plowing action.

Figure 10:
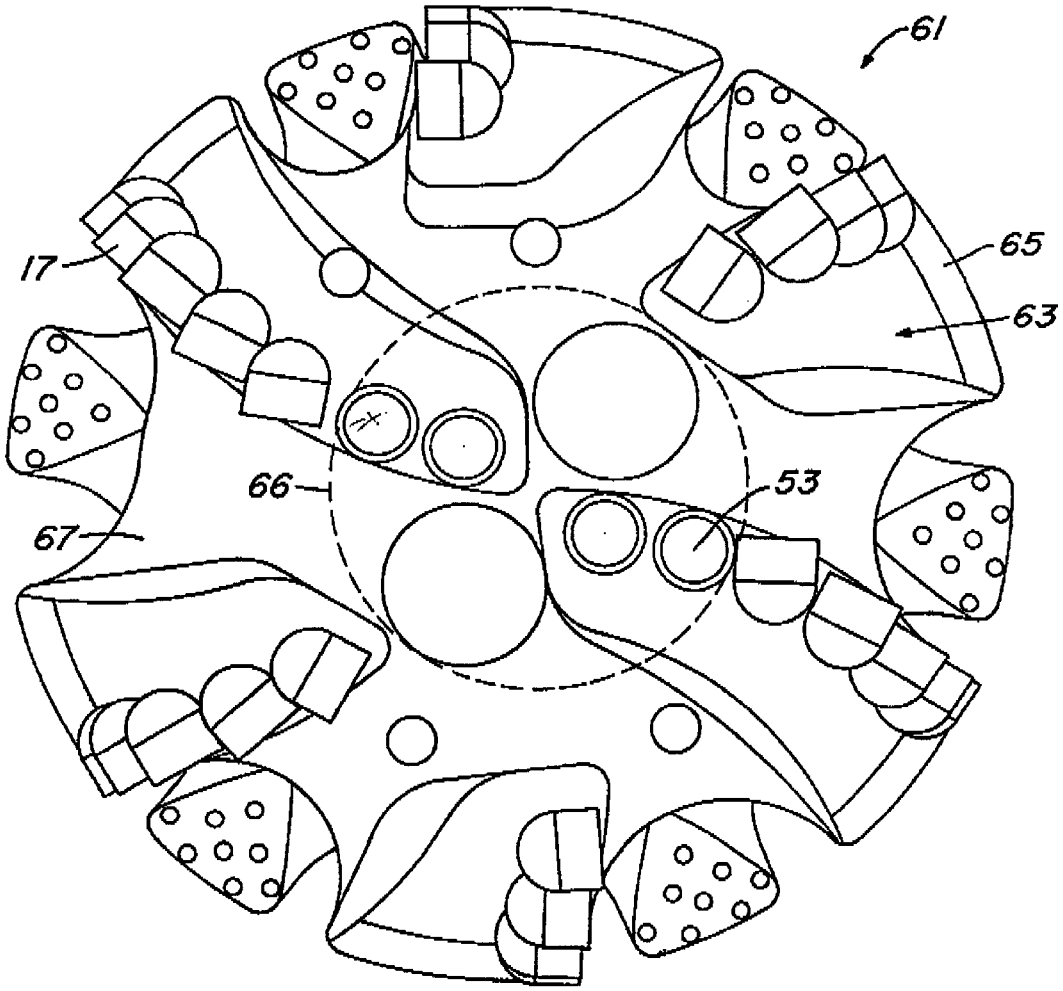
FIG. 10 is a bottom view of the drill bit of FIG. 1 showing a first arrangement of cutting elements constructed in accordance with the invention.

A first embodiment of the invention is shown as an arrangement of cutting elements 53 on the cutting end 63 of a bit 61 in FIG. 10. In this embodiment, only four cutting elements 53 are shown and they are located near the center of cutting end 63. A series of conventional cylindrical cutting elements 17 (FIG. 2) are located between cutting elements 53 and a gage surface 65. Gage surface 65 extends upwardly from cutting end 63 and is proximal to and contacts the sidewall of the borehole during drilling operation of bit 61. A plurality of channels or grooves 67 extend from cutting end 63 through gage surface 65 to provide a clearance area for formation and removal of chips formed by cutting elements 17 and 53. All four cutting elements 53 are located within a circle 66 (indicated by dashed lines) which has a diameter that is less than one-half of the diameter of bit 61. There are no cutting elements 17 within circle 66.

Figure 11:
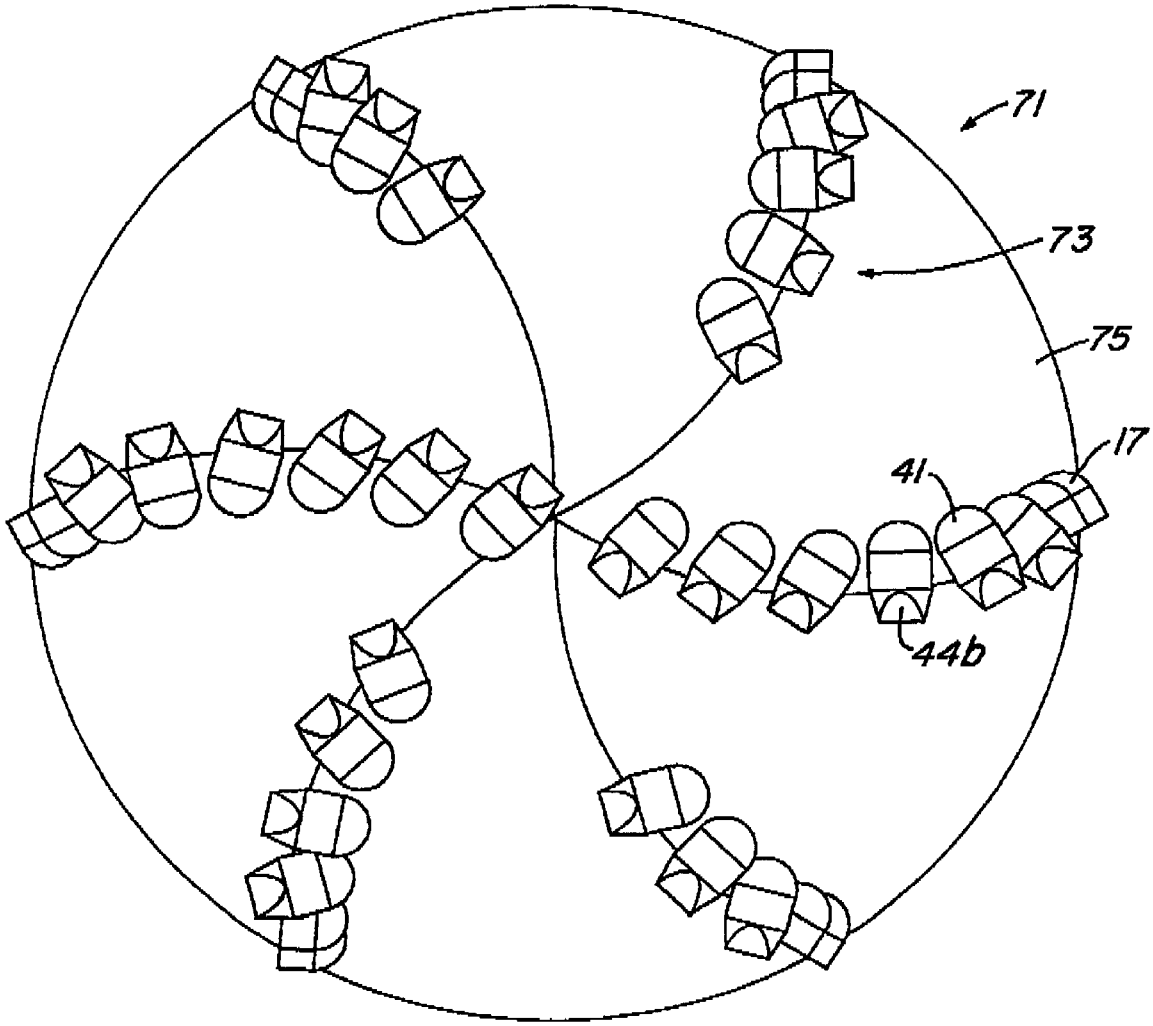
FIG. 11 is a bottom view of the drill bit of FIG. 1 showing a second arrangement of cutting elements constructed in accordance with the invention.

A second embodiment of the invention is shown as an arrangement of cutting elements 41 on the cutting end 73 of a bit 71 in FIG. 11. Cutting elements 41 are configured across the entire cutting end 73 from its center to gage surface 75. A series of conventional cylindrical gage cutting elements 17 are located on gage surface 75 upward and outside of cutting elements 41. The orientation of cutting elements 41 is very similar to that shown in FIG. 4. Each cutting element 41 has leading flank 44*a* and a trailing flank 44*b* which defines a clearance surface.

Figure 12:
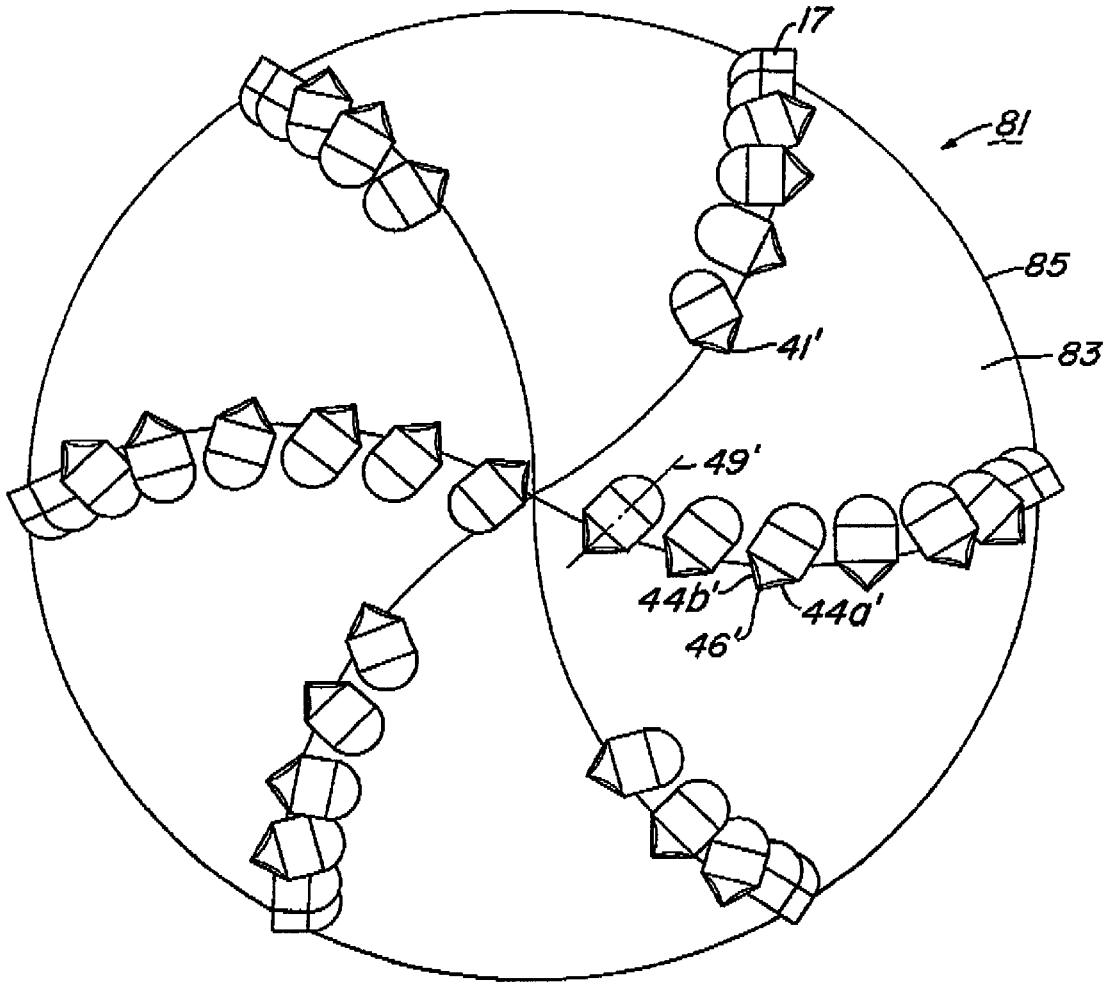
FIG. 12 is a bottom view of the drill bit of FIG. 1 showing a third arrangement of cutting elements constructed in accordance with the invention.
Figure 13:
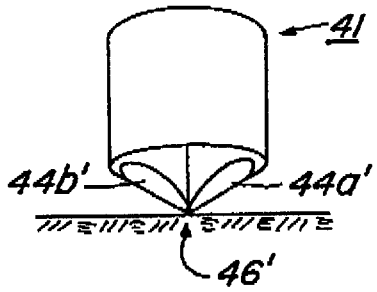
FIG. 13 is an enlarged side view of one of the cutting elements of FIG. 12.
Figure 14:
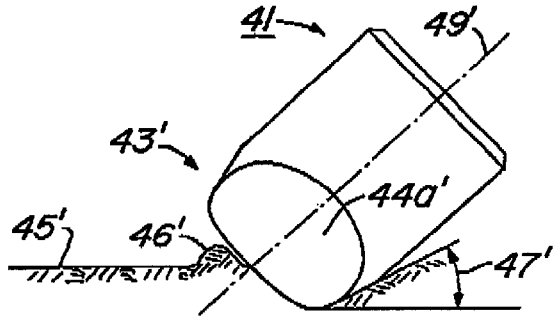
FIG. 14 is a partial plan view of the cutting element of FIG. 13.

Cutting element 41' is a third embodiment of the invention and is shown in FIGS. 12–14. Cutting element 41' has a chisel-tip 43' with noncircular rake faces 44*a*', 44*b*' and crest 46'. As shown in FIG. 14, chisel-tip 43' engages the formation 45' with both rake faces 44*a*', 44*b*' and crest 46'. The longitudinal axis 49' of cutting element 41' is inclined at an angle of approximately 35 to 65 degrees relative to the borehole bottom 45', or to a perpendicular to the axis of rotation of bit 81. The clearance face comprises the trailing portion of the cutting end which is at the angle 47'.

In FIG. 12, a plurality of cutting elements 41' are arranged on the cutting end 83 of a bit 81. In this embodiment, cutting elements 41' have been rotated 90 degrees around their longitudinal axes 49' such that each crest 46' is in a plane that passes through axis 49' and is substantially parallel to the direction of rotation. Cutting elements 41' are configured across the entire cutting end 83 from its center to gage surface 85. A series of conventional cylindrical cutting elements 17 are located on gage surface 85 upward and outside of cutting elements 41'.

The invention has several advantages. The chisel shape and crest orientation increase the initial contact area while reducing aggressiveness. These advantages are achieved without increasing cutter density, reducing back rake, or adding depth of cut limiters. Chisel-shaped cutting elements having crests which are oriented perpendicular to the borehole bottom have the added advantage of displacing the material in a plane that is parallel to the bit face. This reduces the likelihood of harmful bit balling, particularly on heavy set bits with small open face volume.

While the invention has been shown or described in only some of its forms, it should be apparent to those skilled in the art that it is not so limited, but is susceptible to various changes without departing from the scope of the invention.

What is claimed is:

1. An earth-boring bit of the fixed-cutter variety for rotation in a borehole, comprising:

a body having a threaded end for connection into a drillstring and a cutting face located opposite the threaded end for rotation about an axis of the body;

a gage surface extending upwardly from the cutting face, the gage surface adapted to be in contact with a sidewall of the borehole;

a plurality of channels extending from the cutting face through the gage surface;

a plurality of cutting elements, each having a cylindrical base secured to the cutting face, each of the cutting elements having a protruding cutting end, each of the cutting ends having a rake face and a clearance face, and wherein the rake face has a perimeter that is noncircular, the rake face being formed from a super-hard material and facing into the direction of rotation; and wherein the clearance face of each of the cutting elements is planar.

2. An earth-boring bit of the fixed-cutter variety for rotation in a borehole, comprising:

a body having a threaded end for connection into a drillstring and a cutting face located opposite the threaded end for rotation about an axis of the body;

a gage surface extending upwardly from the cutting face, the gage surface adapted to be in contact with a sidewall of the borehole;

a plurality of channels extending from the cutting face through the gage surface;

a plurality of cutting elements, each having a cylindrical base secured to the cutting face, each of the cutting elements having a protruding cutting end, each of the cutting ends having a rake face and a clearance face, and wherein the rake face is noncircular, formed from a super-hard material and faces into the direction of rotation; and wherein the rake face is nonplanar and the face is planar.

3. An earth-boring bit of the fixed-cutter variety for rotation in a borehole, comprising:

a body having a threaded end for connection into a drillstring and a cutting face located opposite the threaded end for rotation about an axis of the body;

a gage surface extending upwardly from the cutting face, the gage surface adapted to be in contact with a sidewall of the borehole;

a plurality of channels extending from the cutting face through the gage surface;

a plurality of cutting elements, each having a cylindrical base secured to the cutting face, each of the cutting elements having a protruding cutting end, each of the cutting ends having a rake face and a clearance face, and wherein the rake face has a perimeter that is noncircular, the rake face being formed from a super-hard material and facing into the direction of rotation; and wherein each of the cutting ends has an end surface which is flat and substantially normal to an axis of the cylindrical base, and wherein the rake face comprises a leading portion of a bevelled surface joining the base with the end surface.

4. An earth-boring bit of the fixed-cutter variety for rotation in a borehole, comprising:

a body having a threaded end for connection into a drillstring and a cutting face located opposite the threaded end for rotation about an axis of the body;

a gage surface extending upwardly from the cutting face, the gage surface adapted to be in contact with a sidewall of the borehole;

a plurality of channels extending from the cutting face through the gage surface;

a plurality of cutting elements, each having a cylindrical base secured to the cutting face, each of the cutting elements having a protruding cutting end, each of the cutting ends having a rake face and a clearance face, and wherein the rake face is noncircular, formed from a super-hard material and faces into the direction of rotation; and wherein the cutting elements are located within a central portion of the cutting face and wherein the cutting face contains an outer annular portion which contains cutters having circular rake faces.

5. The bit of claim 4, wherein the outer annular portion encircles the central portion.

6. An earth-boring bit of the fixed-cutter variety for rotation in a borehole, comprising:

a body having a threaded end for connection into a drillstring and a cutting face located opposite the threaded end for rotation about an axis of the body;

a gage surface extending upwardly from the cutting face, the gage surface adapted to be in contact with a sidewall of the borehole;

a plurality of channels extending from the cutting face through the gage surface;

a plurality of cutting elements, each having a cylindrical base secured to the cutting face, each of the cutting elements having a protruding cutting end, each of the cutting ends having a rake face and a clearance face, and wherein the rake face is noncircular, formed from a super-hard material and faces into the direction of rotation; and wherein the cutting end of each of the cutting elements has two flanks which converge to a crest, the crest being in a plane transverse to the direction of rotation, with a leading one of the flanks being the rake face and a trailing one of the flanks being the clearance face.

7. An earth-boring bit of the fixed-cutter variety for rotation in a borehole, comprising:

a body having a threaded end for connection into a drillstring and a cutting face located opposite the threaded end for rotation about an axis of the body;

a gage surface extending upwardly from the cutting face, the gage surface adapted to be in contact with a sidewall of the borehole;

a plurality of channels extending from the cutting face through the gage surface;

a plurality of cutting elements, each having a cylindrical base secured to the cutting face, each of the cutting elements having a cutting end with two flanks which converge to a crest, each of the cutting ends having a rake face and a clearance face formed from a super-hard; and the base of each of the cutting elements having a longitudinal axis that passes through the crest.

8. The bit of claim 7, wherein the crest of each of the cutting elements is in a plane parallel to the direction of rotation of the body, and wherein the axis of the base is at an angle from 35 to 65 degrees relative to a plane perpendicular to an axis of the body.

9. An earth-boring bit of the fixed-cutter variety for rotation in a borehole, comprising:

a body having a threaded end for connection into a drillstring and a cutting face located opposite the threaded end for rotation about an axis of the body;

a gage surface extending upwardly from the cutting face, the gage surface adapted to be in contact with a sidewall of the borehole;

a plurality of channels extending from the cutting face through the gage surface;

a plurality of cutting elements, each having a cylindrical base secured to the cutting face, each of the cutting elements having a cutting end with two flanks which converge to a crest, each of the cutting ends having a rake face and a clearance face formed from a super-hard material; and wherein the crest of each of the cutting elements is in a plane which is transverse to the direction of rotation of the body, and wherein the base has an axis at an angle from 50 to 85 degrees relative to a plane perpendicular to an axis of the body.

10. An earth-boring bit of the fixed-cutter variety for rotation in a borehole, comprising:

a body having a threaded end for connection into a drillstring and a cutting face located opposite the threaded end for rotation about an axis of the body;

a gage surface extending upwardly from the cutting face, the gage surface adapted to be in contact with a sidewall of the borehole;

a plurality of channels extending from the cutting face through the gage surface; and a plurality of cutting elements, each having a cylindrical base with a longitudinal axis which is skewed approximately 35–130 degrees relative to a plane perpendicular to the axis of the body, the base being mounted on the cutting face, each of the cutting elements having a cutting end, each of the cutting ends having a noncircular rake face facing into the direction of rotation and a clearance face facing away from the direction of rotation, both the rake face and the clearance face formed from a super-hard material; and wherein the cutting end of each of the cutting elements is chisel-shaped, having two flanks converging to a crest which is in a plane that is transverse to the direction of rotation.

11. An earth-boring bit of the fixed-cutter variety for rotation in a borehole, comprising:

a body having a threaded end for connection into a drillstring and a cutting face located opposite the threaded end for rotation about an axis of the body;

a gage surface extending upwardly from the cutting face, the gage surface adapted to be in contact with a sidewall of the borehole;

a plurality of channels extending from the cutting face through the gage surface;

a plurality of cutting elements located within a central portion of the cutting face, each having a cylindrical base mounted to the cutting face, each of the cutting elements having a cutting end, each of the cutting ends having a rake face that has a noncircular perimeter and a clearance face, both the rake face and the clearance face formed from a super-hard material; and an plurality of cutters located on an annular portion of the cutting face surrounding the central portion, the cutters having circular rake faces.

12. The bit of claim 11, wherein the cutting end of each of the cutting elements has two flanks which converge to a crest, and wherein one of the flanks is the rake face and the other of the flanks is the clearance face.

13. The bit of claim 11, wherein each of the cutting ends has an end surface which is substantially normal to an axis of the cylindrical base, and wherein the rake face comprises a leading portion of a bevelled surface which joins the base and the end surface.

14. The bit of claim 11, wherein the cutting end of each of the cutting elements is chisel-shaped, having two flanks converging to a crest which is in a plane that is substantially parallel to the direction of rotation.

* * * * *